US009452453B2

(12) United States Patent
Buijsman

(10) Patent No.: US 9,452,453 B2
(45) Date of Patent: Sep. 27, 2016

(54) SYSTEM AND METHOD FOR UNIFORMLY APPLYING A WETTING AGENT TO A TREATMENT SURFACE

(71) Applicant: Edwin Buijsman, Rotterdam (NL)

(72) Inventor: Edwin Buijsman, Rotterdam (NL)

( * ) Notice: Subject to any disclaimer, the term of this patent is extended or adjusted under 35 U.S.C. 154(b) by 0 days.

(21) Appl. No.: 14/598,789

(22) Filed: Jan. 16, 2015

(65) Prior Publication Data

US 2015/0202661 A1 Jul. 23, 2015

(30) Foreign Application Priority Data

Jan. 17, 2014 (NL) ..... NL2012099

(51) Int. Cl.

| | |
|---|---|
| ***B08B 3/02*** | (2006.01) |
| ***B08B 15/00*** | (2006.01) |
| ***B28B 7/38*** | (2006.01) |
| ***B05B 9/08*** | (2006.01) |
| ***B05B 12/00*** | (2006.01) |
| ***B05B 13/00*** | (2006.01) |
| ***B05B 9/00*** | (2006.01) |

(52) U.S. Cl.

CPC ..... *B08B 3/026* (2013.01); *B05B 9/007* (2013.01); *B05B 9/0861* (2013.01); *B05B 12/008* (2013.01); *B05B 13/005* (2013.01); *B08B 15/00* (2013.01); *B28B 7/388* (2013.01)

(58) Field of Classification Search

None

See application file for complete search history.

(56) References Cited

U.S. PATENT DOCUMENTS

| | | | | |
|---|---|---|---|---|
| 2,639,213 | A | 5/1953 | Barth | |
| 3,354,180 | A * | 11/1967 | Ekiss | B28B 7/384 106/12 |
| 3,556,049 | A | 1/1971 | Hidden et al. | |
| 4,562,088 | A * | 12/1985 | Navarro | B05B 12/08 118/667 |
| 4,705,429 | A * | 11/1987 | Natale | B09B 1/00 241/4 |
| 4,801,088 | A | 1/1989 | Baker | |
| 2003/0210991 | A1 * | 11/2003 | Struthers | F04D 9/008 417/305 |
| 2006/0193973 | A1 | 8/2006 | LaFay et al. | |

FOREIGN PATENT DOCUMENTS

| | | | |
|---|---|---|---|
| DE | 2451113 | A1 | 6/1975 |
| DK | WO2012116697 | * | 9/2012 |
| WO | 2012020012 | A1 | 2/2012 |
| WO | 2013181159 | A1 | 12/2013 |

* cited by examiner

*Primary Examiner* — Nathan T Leong

(74) *Attorney, Agent, or Firm* — Kelly & Kelley, LLP

(57) ABSTRACT

A system and method for uniformly applying a wetting agent to a treatment surface. The method involves providing a reservoir for the wetting agent that is maintained at ambient pressure. The wetting agent is pumped away from the reservoir by an electrically driven suction pump to a nebulizing nozzle. A spray of droplets of the pumped wetting agent is created by passing through the nebulizing nozzle. The spray of droplets is uniformly applied to the treatment surface. In one embodiment, the wetting agent is a formwork fluid and the treatment surface is a concrete formwork. In another embodiment, the wetting agent is an asbestos dampener and the treatment surface is an asbestos containing material.

20 Claims, 2 Drawing Sheets

SYSTEM AND METHOD FOR UNIFORMLY APPLYING A WETTING AGENT TO A TREATMENT SURFACE

RELATED APPLICATION

This application claims priority to Netherlands Patent Application No. NL2012099, filed on Jan. 17, 2014.

BACKGROUND OF THE INVENTION

The present invention is directed to a system and method for uniformly applying a wetting agent to a treatment surface. More specifically, the invention provides for the uniform application of a formwork fluid to concrete formworks so that the formworks may be easily and more reliably removed without damaging the hardened concrete forms. Alternatively, the invention provides for the uniform application of an asbestos dampener so that the removal of asbestos containing materials is less likely to create airborne asbestos particles.

In general, an operating method for applying a fluid, such as a wetting agent or similar, involves the following steps. The wetting agent is transported from a fluid reservoir to a nebulising nozzle. The wetting agent is transported under higher pressure than the surrounding environment and nebulized by causing it to flow out of a nebulizing nozzle. The nebulized wetting agent is then spraying on the treatment surface such as shuttering or similar surface.

Such an operating method is known within the trade. In the known method, whereby the fluid reservoir is placed on a trolley, the air in the fluid reservoir is placed and maintained under increased pressure by means of a hand pump. The increased pressure causes the fluid to be transported to the nozzle, which results in the nebulization of the same. Spray escapes at speed from the nozzle, via one or more flow openings, and whenever the spray contacts a surface it impacts and adheres to it.

The deposited fluid forms a layer on the surface, which—in the case of concrete formwork or shuttering—prevents concrete which has been poured into the shuttering, from adhering thereto during the setting of the concrete, and so hindering the customary removal of the shuttering following hardening. Forming or formwork fluid is in itself well known, and serves to enable shuttering to be more easily separated from poured and hardened concrete. The known operating method has the disadvantage that due to inconsistencies in the amount of pressure through the nebulizing nozzle and the introduction of pressurized air into the system, a significant quantity of forming fluid is required in order to achieve an adequate covering layer.

The aim of the present invention is to achieve an improved operating method for the application of formwork fluid to shuttering, in particular an improved operating method which brings with it a reduction in use of forming fluid for an equivalent area of shuttering surface.

Accordingly, there is a need for a system and method to uniformly apply wetting agents to a treatment surface. The present invention fulfills these needs and provides other related advantages.

SUMMARY OF THE INVENTION

An operating method for applying the wetting agent is characterised by the fact that the transporting of the forming fluid from the fluid's reservoir to the nebulising nozzle is performed by pumping the wetting agent with a mechanically driven pump as opposed to a hand pump. By pumping the wetting agent with a mechanically driven pump, for example an electric pump, instead of with the known hand pump, which is pumped periodically, a more constant fluid pressure is possible, which leads to a more constant quantity of spray per unit of time. It is therefore easier to achieve a constant thickness of layer of deposited wetting agent, as a result of which there are less places where the layer is unnecessarily thick. Therefore less wetting agent is necessary in order to spray the same surface area of treatment surface.

A process for uniformly applying a wetting agent to a treatment surface begins with the step of providing a reservoir for the wetting agent, wherein the reservoir is at ambient pressure. The wetting agent is pumped from the reservoir to a nebulizing nozzle using an electrically driven suction pump. A fluid property of the pumped wetting agent is measured proximate to the nebulizing nozzle. A spray of droplets is created from the pumped wetting agent passing through the nebulizing nozzle. The spray of droplets is applied to the treatment surface in a pattern configured to uniformly coat the treatment surface with the wetting agent.

As described, the fluid property may comprise fluid pressure. In this instance, the process includes adjusting the electrically driven suction pump to create a target fluid pressure proximate to the nebulizing nozzle between 6 Bar and 15 Bar. Preferably, the target fluid pressure is between 8 Bar and 12 Bar. More preferably, the target fluid pressure is between 10 Bar and 12 Bar. Ideally, the target fluid pressure is 11 Bar.

The fluid property may also comprise fluid flow rate. In this instance, the process again includes adjusting the electrically driven suction pump to create a target fluid flow rate proximate to the nebulizing nozzle. The target fluid flow rate varies according to nozzle geometry, considering fluid pressures as described above.

The wetting agent preferably comprises a formwork fluid and the treatment surface comprises a concrete formwork.

Alternatively, the wetting agent may comprise an asbestos dampener and the treatment surface may comprise an asbestos containing material. In this instance, the asbestos dampener preferably comprises a soap/detergent solution. In asbestos removal, the fluid property may comprise fluid pressure with the step of adjusting the electrically driven suction pump to create a target fluid pressure proximate to the nebulizing nozzle as described above, ideally 11 Bar.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
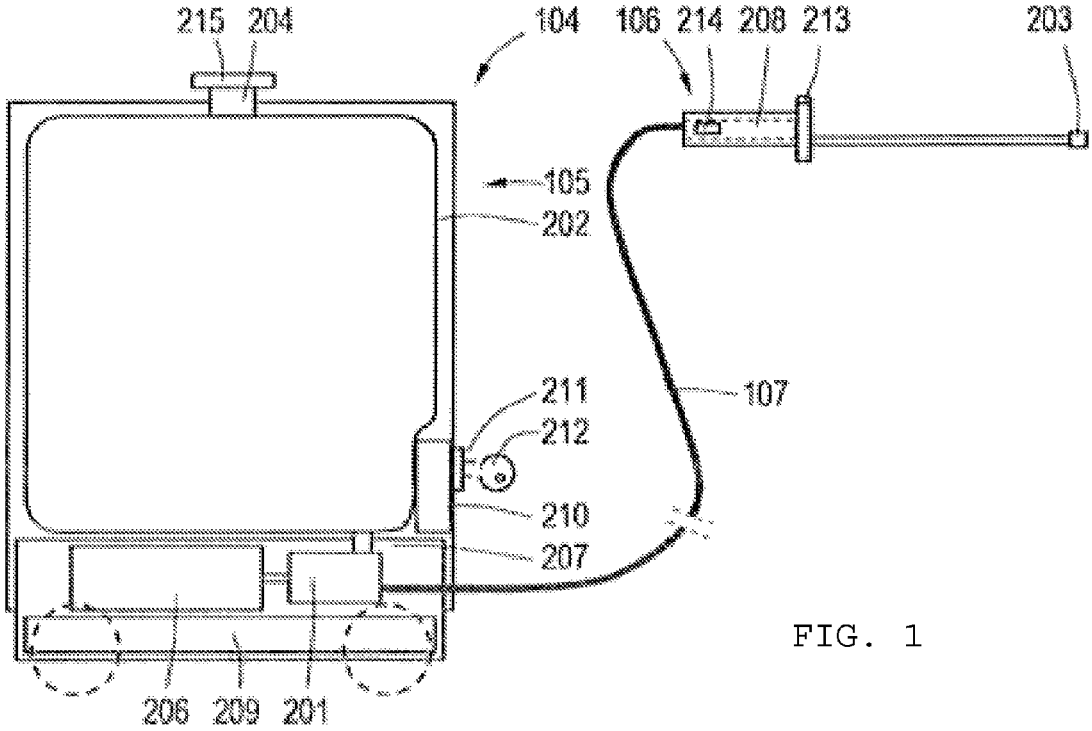
FIG. 1 is an illustration of the system of the present invention.
Figure 2:
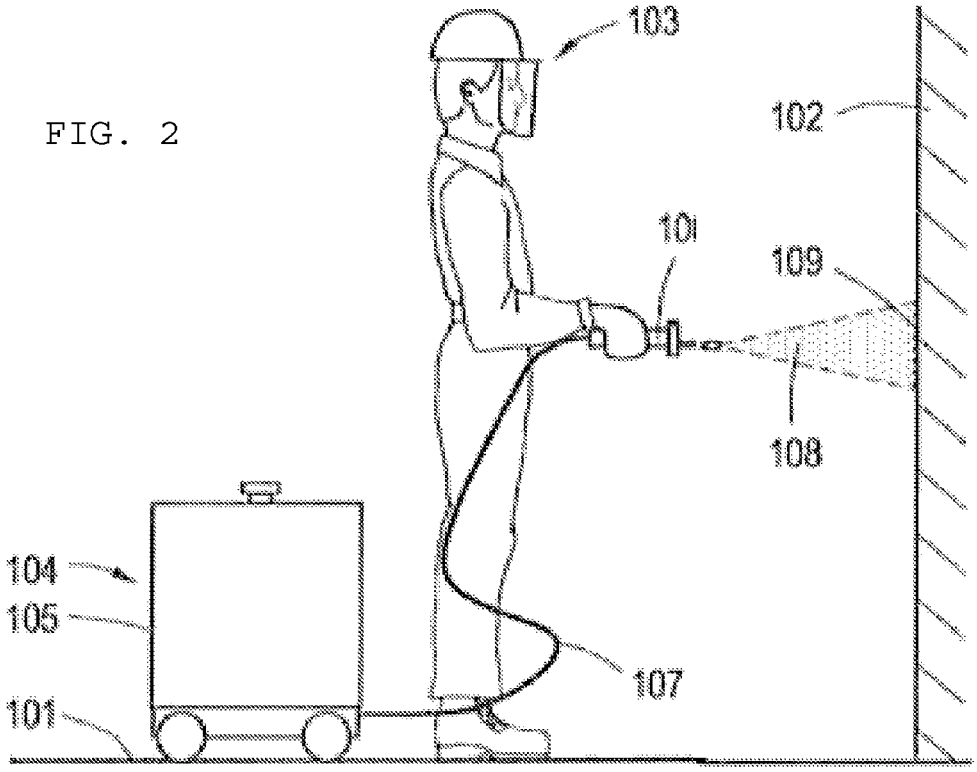
FIG. 2 is an environmental view illustrating a method of using the system of the present invention.

In the following detailed description, the system for uniformly applying a wetting agent to a treatment surface is generally shown in FIGS. 1 and 2. The individual components and the structural relationship of the components of the system are most clearly shown in FIG. 1. A method of using the system is illustrated in FIG. 2.

In FIGS. 1 and 2, the nebulisation system 104 is generally shown. FIG. 2 shows the system 104 in greater detail, with one side of the housing 105 removed in order to provide an interior view. The housing 105 is square and contains the fluid reservoir 202, which is suitable for containing a usable quantity of wetting agent, such as formwork fluid or asbestos dampener, and which can be refilled via a filler opening 204 when the filler cap 215 is removed.

Beneath the fluid reservoir 202 an electric motor 206 is fitted, which is coupled mechanically with the fluid pump 201 in order to drive this. The fluid pump 201 in this example is a membrane pump with three Chambers, but could instead of this be another suitable type of pump for pumping the material to be pumped and for the flow and pressure to be obtained. The fluid pump 201 is preferably a suction pump, meaning that the pump 201 draws fluid away from the reservoir 202 as opposed to pressurizing the reservoir 202 and pushing the fluid out of the reservoir 202.

The fluid tank 202 is in fluid communication with the suction side of the fluid pump 201 via a channel 207. On the pressure side of the fluid pump 201 hose 107 is connected, which leads to the nebulising pistol 106. The nebulising pistol 106 in this example of a system is a metal object that is more or less in the form of a rod or wand, which has a fluid chamber 208 shown in phantom because it is contained within the nebulising pistol 106. The pistol 106 is attached at one end to the hose 107 and at the opposite end to a nebulising nozzle 203. The pistol is otherwise sealed and is a so-called "airless pistol" because no external ports allow for the introduction of air. The nozzle 203 is preferably one with a flat nose. In this example of a system 104 this is a nozzle that can be obtained on the market, of the Lechler make, type series 652 size 403, with a flow of 1.0 liters/minute at a fluid pressure of 2 Bar.

Underneath the housing 105 an electric battery 209 is located, from where the electric motor 206 is fed when the fluid pump 201 is switched on. Furthermore an electronic control mechanism 210 has been fitted, in this embodiment in the form of an electronic switch, positioned next to the fluid reservoir 202. This control mechanism 210 is connected via a key switch 211, which is operated by means of a key 212, to the electric battery 209. An on/off switch 213 associated with the nebulising pistol 106 is also connected to the control mechanism 210 and is capable, together with the key switch 211, of switching the fluid pump 201 respectively on and off.

Within the nebulising pistol 106 a pressure sensor 214 is located within the fluid chamber 208 which when operated converts a pressure signal into an electrical resistance value, and is connected to the control mechanism 210. The control mechanism 210 comprises a microcontroller (not shown) which is programmed to continually regulate the electric motor 206, depending on the fluid pressure as measured from time to time by the pressure sensor 214, in order to maintain the fluid pressure within the fluid chamber 208 generally constant. In the present example of the system 104, the pressure of the system in operation is generally between 6 Bar and 15 Bar. Preferably, the pressure is between 8 Bar and 12 Bar. More preferably, the pressure is between 10 Bar and 12 Bar, specifically 11 Bar.

In this embodiment, the control mechanism 210 takes the form of a digital switch, and pressure measurement by the pressure sensor 214 takes place at regular intervals, for example every 20 milliseconds. The operation of the electric motor 206 is also adjusted every 20 ms to maintain the generally constant pressure in the fluid chamber 208.

In an alternative application system the control mechanism 210 could have a simple on/off function, which would be integrated with the pressure sensor 214. In that instance the control mechanism 210 would not be included in the housing 105. The fluid pump 201 would not be continuously driven in that case, but effectively continuous because the fluid already present between the fluid pump 201 and the nebulising nozzle 203 functions as a pressure buffer which in suitable circumstances is sufficiently high to make up for any pressure fluctuations created by periodic operation of the pump 201. Furthermore this pressure buffer is of constant, or nearly constant, capacity, and thus makes it relatively easy to maintain constant pressure. This is in contrast to prior art systems that pressurized the reservoirs in order to pump the fluid contained therein. Such pressurized reservoirs tend to introduce air into the line, which would take away from the effectively constant fluid pressure in the wand 106.

The system 104 preferably includes a trolley designed for carrying and transporting the free standing nebulising system 104. The trolley supports the system 104, which when filled with fluid has a weight of approximately 19.5 kg, meaning that this can optionally be carried on one's back (with the use of a carrying strap—not shown), or can be placed on the trolley. Furthermore the hose 107 can be exchanged, for applications of varying lengths, with hoses of different lengths, e.g., 3 m and 20 m. The length of 20 m in particular is intended for use with the system 104 on the trolley, so that the operator can walk around during use within a practically usable range.

The nebulising system 104 in the embodiments described shown is constructed from bio-resistant materials, in other words suitable for spraying bio-compatible fluids, and not just (clean) water. In this way, the parts will suffer no, or virtually no, symptoms of wear or degradation when used with bio-compatible fluids.

The invention is not limited to the implementation examples shown. For example the electric motor 206 could be replaced with a compressed air motor, and the battery 209 by a compressed air cylinder, in which case the control mechanism 210 and pressure sensor 214 would not work electronically, but with air or electricity, supported by an auxiliary battery, and would control air valves.

The pressure sensor 214 can also be mounted directly at the pressure side of the fluid pump 201, instead of at a distance from it within the nebulising pistol 106. In practical measurements of the hose 107 the loss of pressure over its length during use resulting from the described arrangement would be sufficiently small for pressure to be measured in a sufficiently reliable way close to the fluid pump 201 instead of within the nebulising pistol 106.

In addition the battery 209 which is built into the housing 105 could be replaced by an external energy supply, such as a cable connected to a battery placed on the ground or on the trolley, which could contain a greater amount of energy, without the person operating the nebulising system having to continually carry the battery during use of the system.

Furthermore the fluid reservoir 202, although portable, could be placed on the ground or on the trolley, like the battery, outside the housing 105, equally in order to reduce the strain on the operative.

In FIG. 2, shuttering panel or concrete formwork 102 is shown standing on the base 101 of a bridge pillar or similar construct. A second, third, and fourth panel (not shown) remain to be positioned, in order to create an enclosed pouring form for concrete, between the each of the first, second, third and fourth shuttering panels 102. A layer of forming or formwork fluid is being applied to the shuttering panel 102, in order to ensure that the concrete easily comes free from the shuttering panels when it is removed, after the concrete has been poured and set. Removing the shuttering panels 102 after pouring concrete is normal, given that they are no longer required once the poured concrete has hardened.

In FIG. 2, an operator 103 is shown who is using the nebulising system 104, which is transportable as described. As described, the nebulising system 104 has, a housing 105 which also serves as a frame, and the operator is carrying a nebulising pistol 106. The nebulising pistol 106 is connected by a hose 107 to an electrically driven fluid pump 201, which is attached within and onto the housing 105. The fluid pump 201 is connected to the fluid reservoir 202. When the fluid pump 201 is in operation, that is to say is being driven, and forming or formwork fluid is present in the fluid reservoir 202, the fluid pump 201 will draw the formwork fluid from the reservoir 202 and under pressure pump it to the nebulising pistol 106. At the nebulizing pistol 106, the formwork fluid is nebulised by means of the nebulising nozzle 203, present in the nebulising pistol 106.

The operator 103 has pointed the nebulising pistol 106 in the direction of the concrete formwork panel 102, as a result of which the nebulised forming fluid will impact on the shuttering panel and will remain there by means of adhesive qualities. In FIG. 2, the visible consequences of these steps are shown in the form of a mist cluster 108 and a layer of forming fluid 109 applied to the shuttering panel 102.

Another consequence of the use of the nebulising system 104, which is not however visible in FIG. 2, is that the layer 109 is made up of very fine droplets and has a relatively regular thickness in comparison with a layer such as would be obtained in accordance with the current level of technology as described, in which a hand pump is used.

As discussed herein, the term "mechanically driven pump" is intended to mean "a pump that is not pumped by hand". In practice this means a pump that is constantly pumped, in the sense that periodically switching an electric pumping motor on and off does not count as continuous pumping, whilst electronic control of an electric pumping motor with a pulse width modulation does count as continuous pumping. The reason for this is that the interruptions of the energy supply to the motor which are caused by pulse width modulation are so short that the motor, due to its inertia, does not transmit these interruptions to the pump.

The arrangement used for the inventive method, comprises the pump as stated, the fluid reservoir and the nebulising spout. Such arrangement is preferably configured in a way that is portable, i.e., light enough in weight for a person carrying out the operating method to continuously carry it on his back during use, or that it stands on the ground and is repositioned from time to time by a person carrying out the operating method by being lifted up in order to be able to reach another part of the shuttering and to apply forming fluid to it. A typical weight of such a system is preferably less than 10 kg with an empty fluid reservoir, and preferably less than 20 kg with a completely filled fluid reservoir, this latter being in the interest of protecting people from excessive physical strain.

A preferred form of implementation for this is characterised by the fact that the pump only pumps forming fluid from the reservoir. By making the pump only pump forming fluid, without air, there is a more direct connection between pump activity and achieved fluid pressure, and it is easier to maintain constant pressure, potentially of a specific chosen value. Furthermore pumping forming fluid without air prevents the fluid reservoir being put under pressure, and this can therefore be less strongly constructed.

A preferred embodiment is characterised by the fact that the control for the pump function is achieved by means of regulation of the pump function, dependent on a signal of measured fluid pressure or flow of fluid between the pressure side of the pump and the nebulising nozzle, transmitted by a sensor. In this way, it is possible to achieve better control of pressure and in particular of flow of the fluid emitted from the nebulising nozzle, and therefore less forming fluid is required. A pressure sensor can be positioned close to the nebulizing nozzle for a reliable measurement, specifically close to its forming fluid spray openings. A pressure sensor can also be positioned close to the pump, which is advantageous for example from the point of view of lower production costs. In the case of a flow meter, in principle any point between the fluid reservoir and the nebulising nozzle is suitable.

Such placement of the sensor makes the pump setting instantly responsive and adjustable, so that it takes little time and/or effort in order to adjust the pressure or the flow for different circumstances, such as a different fluid with higher or lower viscosity or chemical composition, or a different treatment surface, or a battery that is nearly empty.

Another preferred embodiment is characterised by the fact that the nebulisation of the transported fluid is performed with the use of a nebulising nozzle of the type with a flat nose. A nebulising nozzle of the type with a flat nose is also referred to within the trade by the English term "flat tip nozzle". By making use of a nebulising nozzle of the type with a flat nose, an accurately defined spray cluster can be achieved, preferably a flat cluster, or a filled conical cluster. Furthermore this spray cluster comprises a highly consistent spread of very fine spray droplets. These fine spray droplets in turn make possible a fine spraying pattern. This means that the thickness of the layer of deposited wetting agent is relatively consistent and therefore it is possible for a thin layer to suffice to achieve a sufficient thickness of layer for the wetting agent to function properly at all points. As a result of this an even smaller quantity of wetting agent is necessary for a consistently sprayed surface.

Yet another preferred embodiment is characterised by the fact that the pressure generated by the pump used with formwork fluid is higher than 6 Bar, preferably higher than 8 Bar and ideally higher than 10 Bar. Such a pressure, which is relatively high in comparison with pressures achieved by the commonly used nebulising systems with hand pumps, leads, in particular in combination with the use of a nebulising nozzle of the type with a flat nose, to very small droplets which enable an extra fine spraying pattern, and therefore a more efficient use of the forming fluid. Conversely, the pressure generated by the pump is preferably lower than 15 Bar, preferably lower than 12 Bar, and ideally at 11 Bar.

When a battery fed pump is used in the operating method, it is advantageous in the light of the limited quantity of energy present in batteries that are manageable in practice, in terms of weight and size, to apply a level of pressure that only requires a limited amount of energy. Limiting the pressure is also advantageous in terms of safety considerations; very high pressure can lead to injury to the person operating the system used in the operating method, and also to bystanders.

By making use of a mechanically driven pump, in combination with a nebulising nozzle of the type with a flat nose, it is made possible to cover the working surface with a sufficiently thick level of wetting agent for the adhesion-prevention function to work, with less wetting agent than in the known system. This is possible because a previously unforeseen fine spray pattern is obtained.

A favourable implementation form is characterised by the fact that the system comprises a sensor which is set up to measure pressure or fluid flow present between the fluid reservoir and the nebulising nozzle, and it comprises a drive mechanism that is connected to the sensor and to the pump, and is established for controlling the function of the pump based on a measurement signal given by the sensor. By making use of the control of the function of the pump in the described manner it is possible to obtain a desired pressure or flow function, specifically for the most efficient use of forming fluid possible. As a rule this will be a constant pressure level or a constant level of flow. A favourable form of implementation is characterised by the fact that the control mechanism comprises a means of adjustment for the adjustment of the setting for the level of fluid pressure in the nebulisation nozzle while the system is in use. Due to the presence of the adjustment mechanism it is possible to instantly adapt the quantity of nebulised fluid to the nature of the surface to be covered, and in this way to permanently obtain a suitable, sufficient level of thickness of layer.

Another preferred embodiment is characterised by the fact that the control mechanism is set to generate a pressure higher than 6 Bar within the fluid transported to the nebulising nozzle during the use of the system, preferably higher than 8 Bar and ideally higher than 10 Bar. The pump is also configured to generate a pressure during use of less than 15 Bar within the fluid transported to the nebulising nozzle, preferably lower than 12 Bar, ideally at 11 Bar.

The sensor is preferably configured to measure fluid pressure or fluid flow within the nebulising nozzle. By measuring the pressure or the flow rate within the nebulising nozzle a more reliable measurement is obtained than by measuring at a greater distance. In this way both the static pressure within the fluid space of the nebulising nozzle is measured, and the dynamic pressure of fluid nearby or flowing through the outlet openings. The measurement can take place directly, or via the measurement of another parameter which is closely related to the pressure or flow.

In a particularly preferred embodiment, the pump is a fluid pump whose inlet for fluid communication is connected to the fluid reservoir, and the outlet for fluid communication is in connection to the nebulising nozzle. By making use of a fluid pump, for example a membrane pump or vane pump, which is connected to the nebulising nozzle, whether or not via a tube, more direct regulation of the pressure at the nozzle is possible than if the pump is for example an air pump and the reservoir is placed under pressure by pumping air into it. Furthermore the use of a fluid pump that is connected to the nebulising nozzle prevents the reservoir being put under pressure, and this can therefore be less strongly constructed and have a lower cost price.

In this way a system is possible that makes more efficient use of the forming fluid. The system is preferably portable; this is achieved effectively if the battery is an LFP battery.

In one preferred embodiment, the system is configured for use with concrete formworks, wherein the wetting agent comprises a formwork fluid and the treatment surface comprises concrete formwork. The formwork fluid is configured to facilitate the removal of formworks from the hardened concrete after it has been poured and cured. The types of formwork fluids known in the art can be used in this system to achieve a uniform coating on the concrete formwork. Some basic types of formwork fluids include petroleum oils, emulsions, non-reactive materials with volatile solvents, waxes, and chemically active agents containing fatty acids.

In another preferred embodiment, the system is configured for use with asbestos removal, wherein the wetting agent comprises an asbestos dampener, such as a soap/detergent solution, i.e., surfactant, and the treatment surface comprises an asbestos containing material, particularly a material that becomes easily airborne. In the case of asbestos removal, prior art methods relied on systems with a fluid pressure much less than that suggested for concrete formworks. If the fluid pressure were too high, the impact of high pressured spray upon the asbestos material may cause it to become airborne. The system and method of the present invention allows for higher pressures to be used without the risk or danger of releasing airborne asbestos particles. Fluid pressures of between 6 Bar and 15 Bar, preferably 11 Bar as described above, can be used with the inventive system and method to achieve thorough wetness and penetration of the asbestos material.

Although several embodiments have been described in detail for purposes of illustration, various modifications may be made without departing from the scope and spirit of the invention. Accordingly, the invention is not to be limited, except as by the appended claims.

What is claimed is:

1. A process for uniformly applying a wetting agent to a treatment surface, comprising the steps of:

providing a reservoir for the wetting agent, wherein the reservoir is at ambient pressure;

providing a nebulizing pistol having a fluid chamber connected to a nebulizing nozzle, wherein the fluid chamber is in fluid communication with the reservoir;

continuously pumping the wetting agent from the reservoir to the fluid chamber using an electrically driven suction pump;

measuring a fluid pressure of the wetting agent in the fluid chamber;

maintaining the fluid pressure of the wetting agent in the fluid chamber generally constant during the step of continuously pumping the wetting agent;

creating a spray of droplets of the wetting agent from the nebulizing nozzle; and applying the spray of droplets to the treatment surface in a pattern configured to uniformly coat the treatment surface with the wetting agent.

2. The process of claim 1, further comprising the step of adjusting the electrically driven suction pump in response to the measured fluid pressure in the fluid chamber so as to create a target fluid pressure in the fluid chamber between 6 Bar and 15 Bar.

3. The process of claim 2, wherein the target fluid pressure is between 8 Bar and 12 Bar.

4. The process of claim 3, wherein the target fluid pressure is between 10 Bar and 12 Bar.

5. The process of claim 4, wherein the target fluid pressure is 11 Bar.

6. The process of claim 1, wherein the wetting agent comprises a formwork fluid and the treatment surface comprises a concrete formwork.

7. The process of claim 6, wherein the formwork fluid comprises a petroleum oil, an emulsion, a non-reactive coating with a volatile solvent, a wax, or a chemically active agent containing fatty acids.

8. The process of claim 1, wherein the wetting agent comprises an asbestos dampener and the treatment surface comprises an asbestos containing material.

9. The process of claim 8, wherein the asbestos dampener comprises a soap or detergent solution.

10. A process for uniformly applying a formwork fluid to a surface of a concrete formwork, comprising the steps of:

providing a reservoir for the formwork fluid, wherein the reservoir is at ambient pressure;

providing a nebulizing pistol having a fluid chamber connected to a nebulizing nozzle, wherein the fluid chamber is in fluid communication with the reservoir;

continuously pumping the formwork fluid from the reservoir to the fluid chamber using an electrically driven suction pump;

measuring nozzle fluid pressure of the formwork fluid in the fluid chamber;

maintaining the fluid pressure of the formwork fluid in the fluid chamber generally constant during the step of continuously pumping the formwork fluid;

creating a spray of droplets of the formwork fluid from the nebulizing nozzle; and applying the spray of droplets to the surface of the concrete formwork in a pattern configured to uniformly coat the surface with the formwork fluid.

11. The process of claim 10, further comprising the step of adjusting the electrically driven suction pump in response to the measured fluid pressure in the fluid chamber so as to create a target fluid pressure in the fluid chamber between 6 Bar and 15 Bar.

12. The process of claim 11, wherein the target fluid pressure is between 8 Bar and 12 Bar.

13. The process of claim 12, wherein the target fluid pressure is between 10 Bar and 12 Bar.

14. The process of claim 13, wherein the target fluid pressure is 11 Bar.

15. The process of claim 10, wherein the formwork fluid comprises a petroleum oil, an emulsion, a non-reactive coating with a volatile solvent, a wax, or a chemically active agent containing fatty acids.

16. A process for uniformly applying an asbestos dampener to a surface of an asbestos containing material, comprising the steps of:

providing a reservoir for the asbestos dampener, wherein the reservoir is at ambient pressure;

providing a nebulizing pistol having a fluid chamber connected to a nebulizing nozzle, wherein the fluid chamber is in fluid communication with the reservoir;

continuously pumping the asbestos dampener from the reservoir to the fluid chamber using an electrically driven suction pump;

measuring a fluid pressure of the asbestos dampener in the fluid chamber;

maintaining the fluid pressure of the asbestos dampener in the fluid chamber generally constant during the step of continuously pumping the asbestos dampener;

creating a spray of droplets of the asbestos dampener from the nebulizing nozzle; and applying the spray of droplets to the surface of the asbestos containing material in a pattern configured to uniformly coat the surface with the asbestos dampener.

17. The process of claim 16, further comprising the step of adjusting the electrically driven suction pump in response to the measured fluid pressure in the fluid chamber so as to create a target fluid pressure in the fluid chamber between 6 Bar and 15 Bar.

18. The process of claim 17, wherein the target fluid pressure is between 10 Bar and 12 Bar.

19. The process of claim 18, wherein the target fluid pressure is 11 Bar.

20. The process of claim 16, wherein the asbestos dampener comprises a soap or detergent solution.

* * * * *